US011616321B2

(12) United States Patent
Lin

(10) Patent No.: US 11,616,321 B2
(45) Date of Patent: Mar. 28, 2023

(54) RECEPTACLE CONNECTOR WITH CABLE-CLAMPED STRUCTURE

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/333,674

(22) Filed: May 28, 2021

(65) Prior Publication Data

US 2022/0384989 A1 Dec. 1, 2022

(51) Int. Cl.
*H01R 13/58* (2006.01)
*H01R 4/2406* (2018.01)

(52) U.S. Cl.
CPC ..... *H01R 13/5829* (2013.01); *H01R 4/2406* (2018.01); *H01R 13/5837* (2013.01)

(58) Field of Classification Search
CPC ..... H01R 13/5812; H01R 13/5829; H01R 13/5837
See application file for complete search history.

(56) References Cited

U.S. PATENT DOCUMENTS

| | | | | |
|---|---|---|---|---|
| 7,371,106 | B2 | 5/2008 | Nad | |
| 7,713,081 | B2 | 5/2010 | Chen | |
| 2021/0184394 | A1* | 6/2021 | Wang | H01R 13/59 |

* cited by examiner

*Primary Examiner* — Ross N Gushi
(74) *Attorney, Agent, or Firm* — WPAT, PC

(57) ABSTRACT

A receptacle connector with a cable-clamped structure of the invention includes a housing, an electrical module and a cable clamping module. The electrical module is disposed in the housing and includes a circuit board, a plurality of contacting terminals and a plurality of prick type terminals. The circuit board is disposed in the housing. The contacting terminals and the prick type terminals are disposed on the printed circuit board. The cable clamping module includes a first clamping member, a second clamping member and a cable clamper, wherein the first clamping member engages the second clamping member, and the cable clamper is pivoted to the first clamping member. A cable extends through the first clamping member and the second clamping member engaging the first clamping member, the cable clamper presses the cable with the first positioning portion positioned in the second positioning portion of the first clamping portion.

10 Claims, 8 Drawing Sheets

RECEPTACLE CONNECTOR WITH CABLE-CLAMPED STRUCTURE

BACKGROUND OF THE INVENTION

Field of the Invention

The invention relates to a receptacle connector, and more particularly to a receptacle connector with a cable-clamped structure.

Description of the Related Art

The network module socket is usually used to connect various network cables in the network computer room, including single wire, multiple wires, and wires of various diameters. The network module socket in the prior art is provided with an electrical module in a housing, and the contact terminal of the electrical module extends to a receiving opening close to the housing. The contact terminals are in contact with the terminal of the plug connector when the mating plug connector is inserted into the housing. The rear end of the housing is provided with a prick type terminal slot, the prick type terminal of the electrical module is set in the prick type terminal slot, and the multiple core wires of the cable are set in the multiple fixing slots of a wire securing structure. A cover pivoted to the rear end of the housing is pressed the housing so that the wire securing structure is crimped to the prick type terminal groove at the rear end of the housing, so that the prick type terminal of the electrical module is pierced through the core wire to achieve electrical connection.

U.S. Pat. No. 7,713,081 discloses a structure similar to the aforementioned structure. However, U.S. Pat. No. 7,713,081 has two covers connected to a front case of the housing, and the rear case is exposed for a cable being inserted thereinto when the covers are opened. The wires of the cable are connected to the prick type terminals. When the covers are in a closed position, the rear case is covered and a clamping section is formed. A cable pressing block is mounted to a rear end of one of the covers and regularly extends to the clamping section. When the covers are in the closed position, the cable pressing block contacts the network cable and push the cable to abut the other cover.

U.S. Pat. No. 7,371,106 discloses a cover with two grooves on opposite sides. Several engaging structures are disposed on the other side of the grooves. When the connector is mounted to a network module, an M-shaped metal sheet is inserted into the groove to form a hook structure engaging the engaging structure.

The aforementioned receptacles have engaging structures for network cable of different diameters. U.S. Pat. No. 7,713,081 utilizes the spring structure, but the spring is compressible so that the cable pressing block may have no contact with the network cable when the network cable is offset. As for U.S. Pat. No. 7,371,106, although the condition of no contact never happens, the parts of the connector are increased.

Brief Summary of the Invention

An object of the invention is to provide a receptacle connector with cable clamping structure including a pair of clamping members, and one of the clamping member is provided with a cable clamper capable of adjusting clamping position according to a diameter of the cable. The cable clamper is positioned by a positioning structure after the cable clamper has clamped the cable, whereby the cable is clamped between the clamping members. Therefore, even if the network cable is offset, the cable clamper still clamps the cable.

The invention provides a receptacle connector with a cable-clamped structure. The receptacle connector with a wire clamped structure in accordance with an exemplary embodiment of the invention includes a housing including a front case and a rear case, wherein the front case has a receiving opening through which a plug connector is inserted and an accommodating space, and the rear case has a plurality of prick type terminal slots; an electrical module disposed in the housing and including a circuit board disposed between the front case and the rear case, a plurality of contacting terminals disposed on the printed circuit board and a plurality of prick type terminals disposed on the printed circuit board, wherein the contacting terminals are disposed near the receiving opening for contacting terminals of the plug connector, and the prick type terminals are disposed in the prick type terminal slots and connected to a wire of a cable; and a cable clamping module including a first clamping member, a second clamping member and a cable clamper, wherein the first clamping member engages the second clamping member, and the cable clamper is pivoted to the first clamping member; wherein the cable clamper includes a pressing portion and a first positioning portion, the first clamping member includes a second positioning portion, a cable extends through the first clamping member and the second clamping member engaging the first clamping member, the pressing portion presses the cable with the first positioning portion positioned in the second positioning portion of the first clamping portion.

The receptacle connector with a cable-clamped structure of the invention includes a cable clamper disposed in the first clamping member, and the position of the cable clamper is adjusted according to the diameter of the cable, and afterwards the cable clamper is positioned in the first clamping member. Therefore, even if the network cable is offset, the cable clamper still clamps the cable.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 3 is an enlarged view of a cable clamper of the receptacle connector of

FIG. 1;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Referring to FIGS. 1 to 5, the receptacle connector 1 with a cable-clamped structure of the invention includes a housing 1, an electrical module 20 and a cable clamping module 30.

Figure 5:
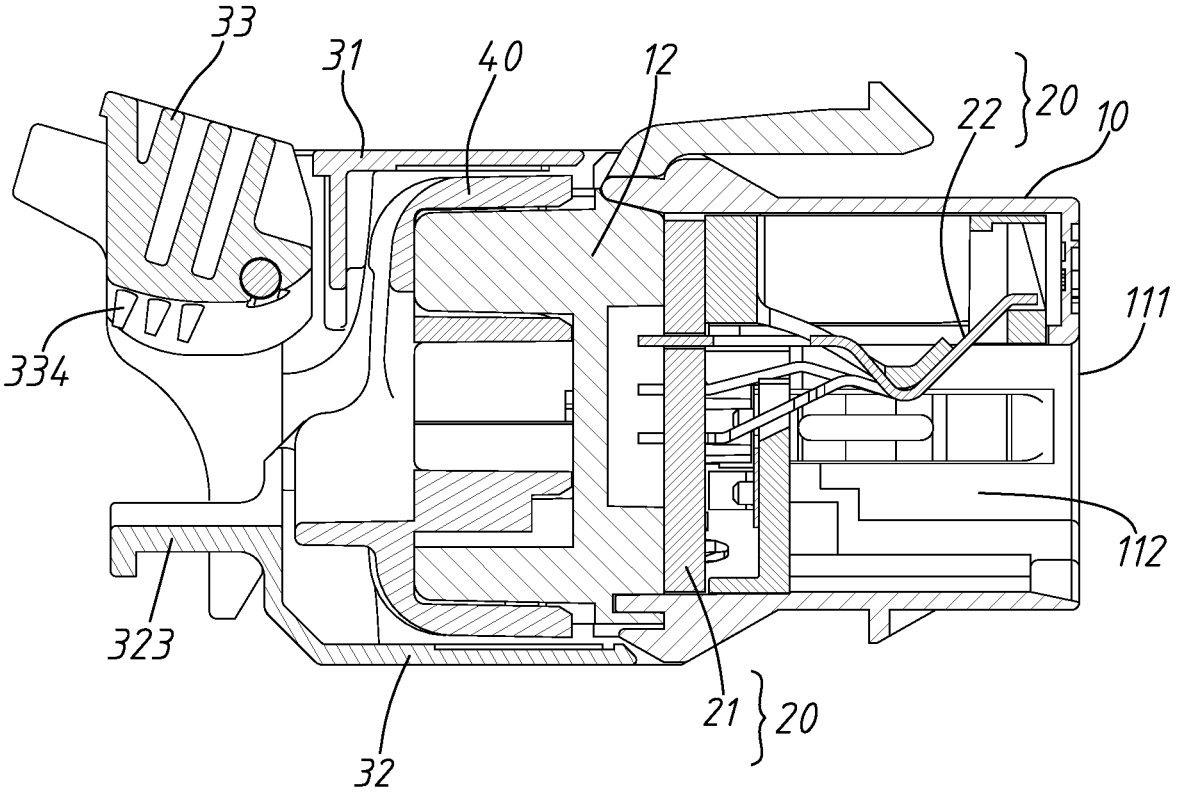
FIG. 5 is a cross section of the receptacle connector of FIG. 1.

The housing 10 includes a front case 11 and a rear case 12. As shown in FIG. 5, the front case 11 has a receiving opening 111 and an accommodating space 112 formed in the housing 10. The receiving opening 111 communicates with the accommodating space 112. A plug connector is inserted into the accommodating space 112 through the receiving opening 111. The rear case 12 has a plurality of prick type terminal slots.

As shown in FIG. 5, the electrical module 20 is disposed in the housing 10 and includes a circuit board 21, a plurality of contact terminals 11 and a plurality of prick type terminals. The circuit board 21 is disposed between the front case 11 and the rear case 12. The contact terminals 11 and the prick type terminals are disposed on opposite sides of the circuit board 21. The contact terminals 11 are disposed near the receiving opening 111 and contacts the terminals of the plug connector to achieve electrical connection. The prick type terminals are disposed in the prick type terminal slots and pierce the wires of the cable to achieve electrical connection.

Figure 1:
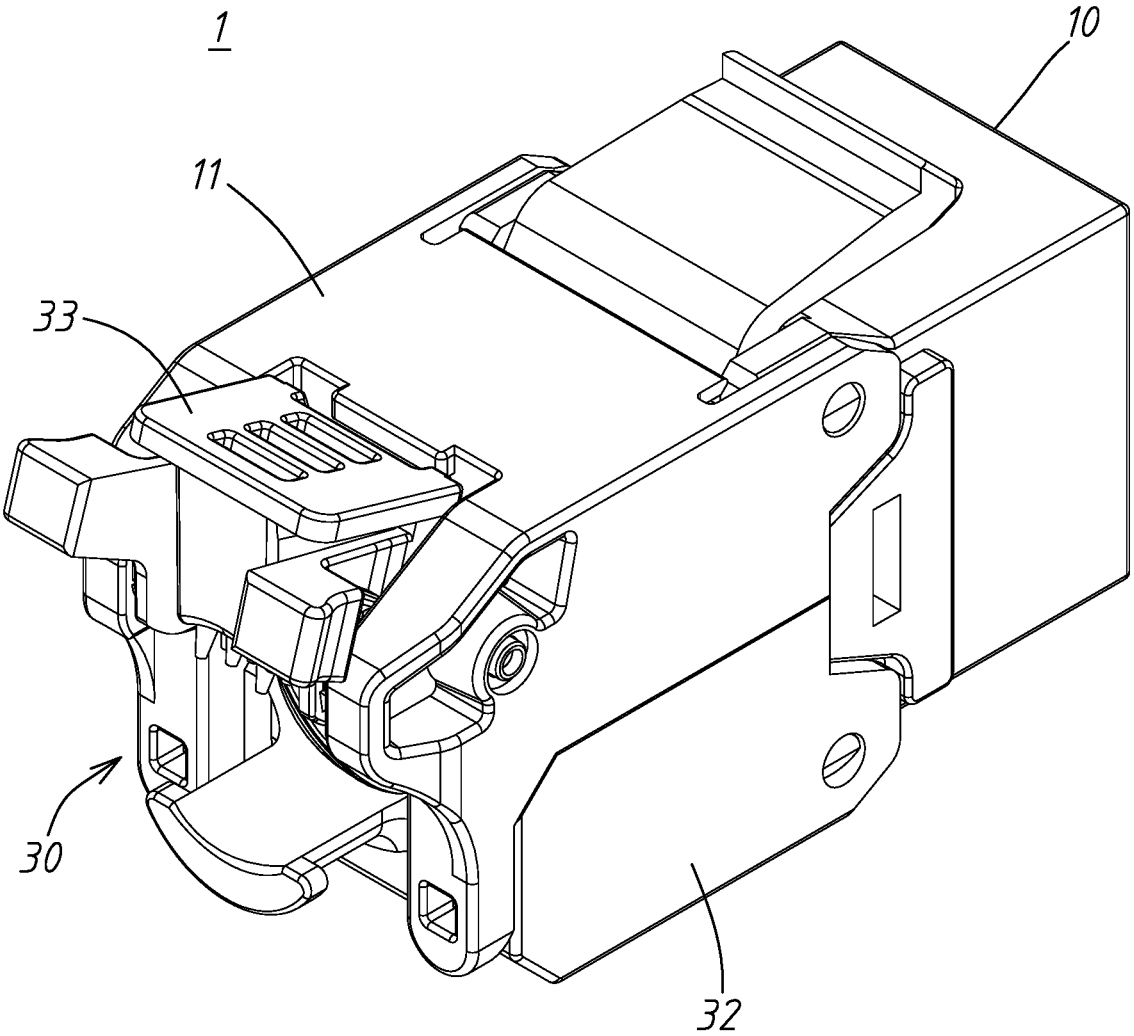
FIG. 1 is a perspective view of an embodiment of a receptacle connector with a cable-clamped structure of the invention.
Figure 2:
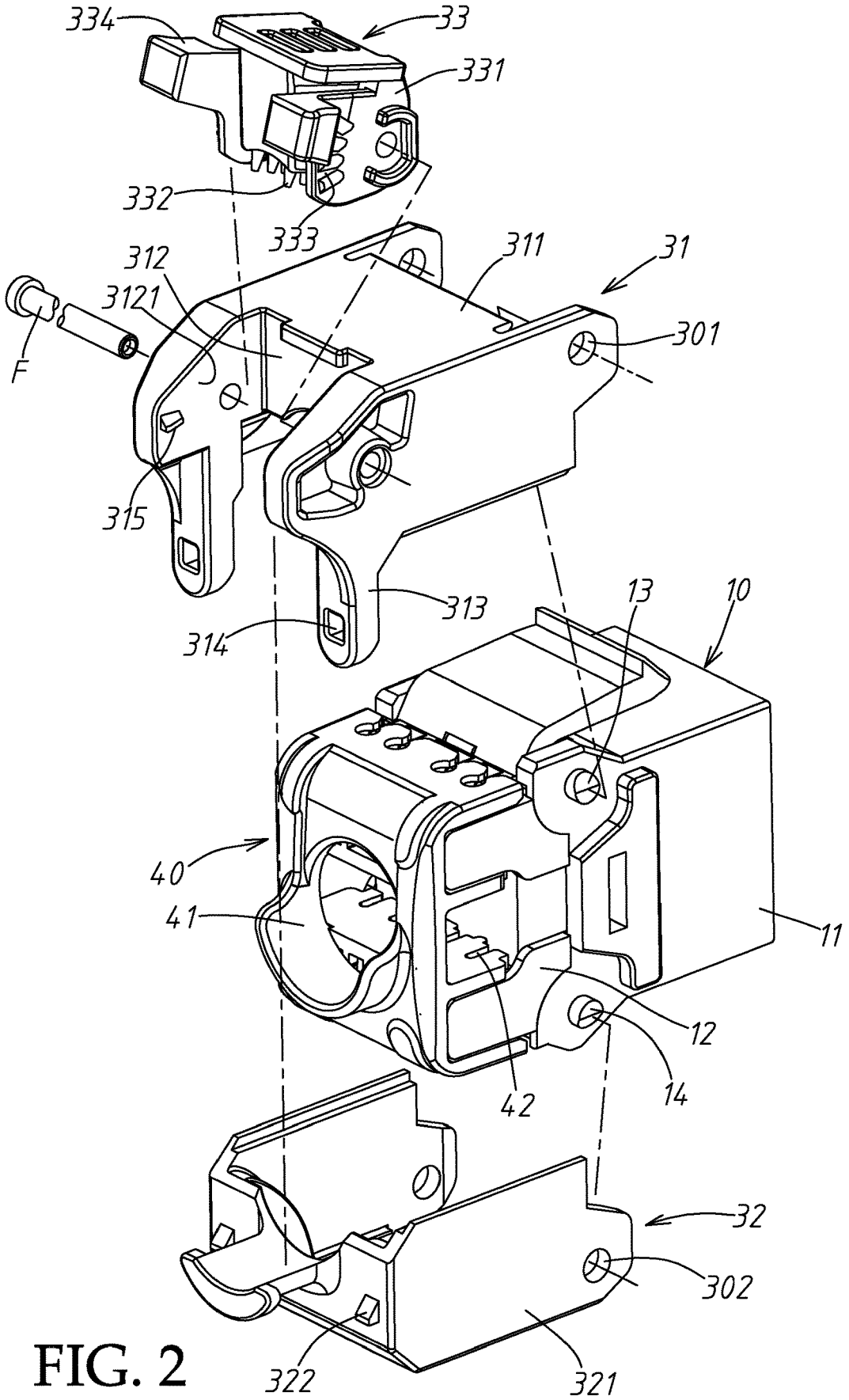
FIG. 2 is an exploded view of the receptacle connector of FIG. 1.
Figure 3:
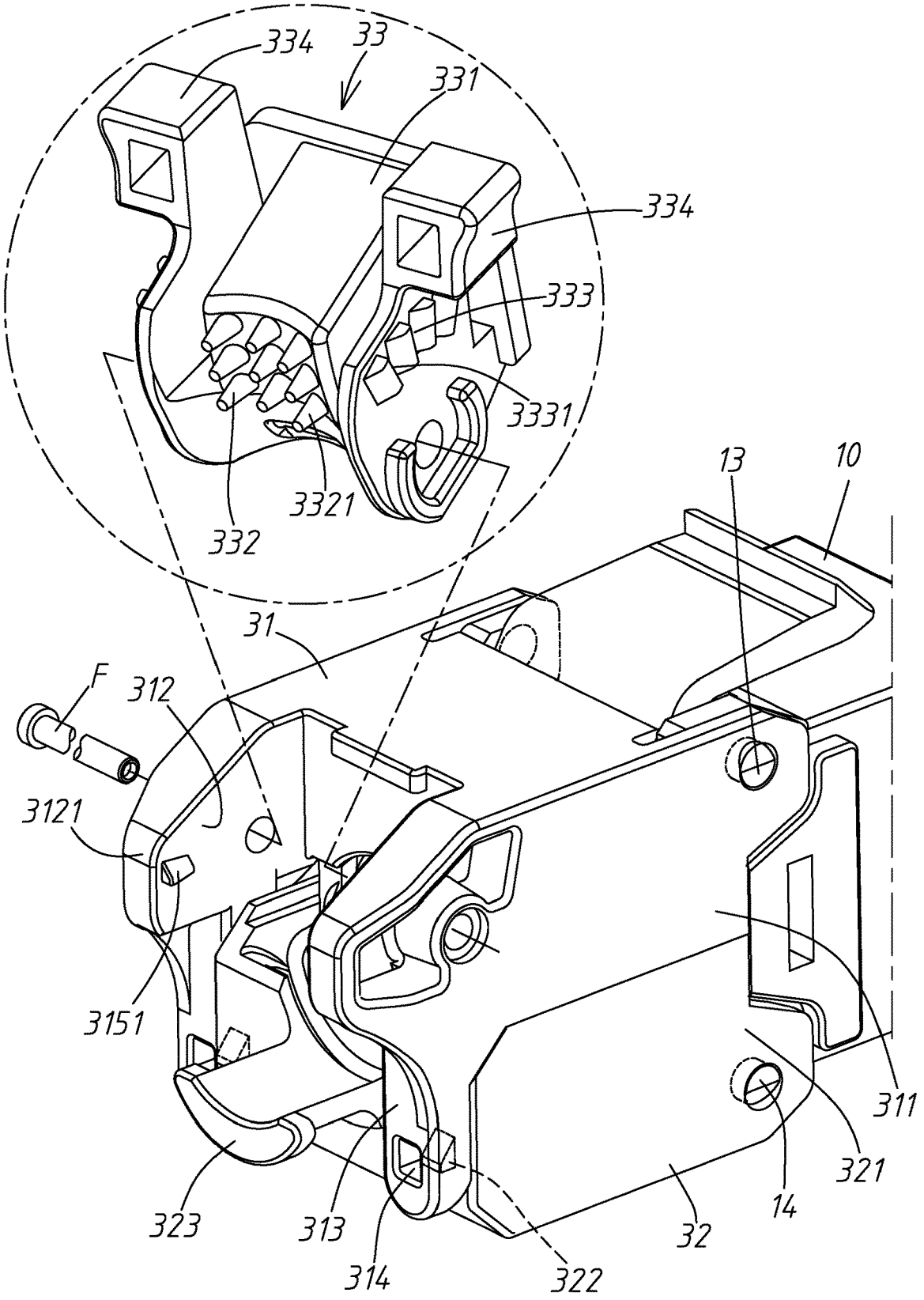
Figure 4:
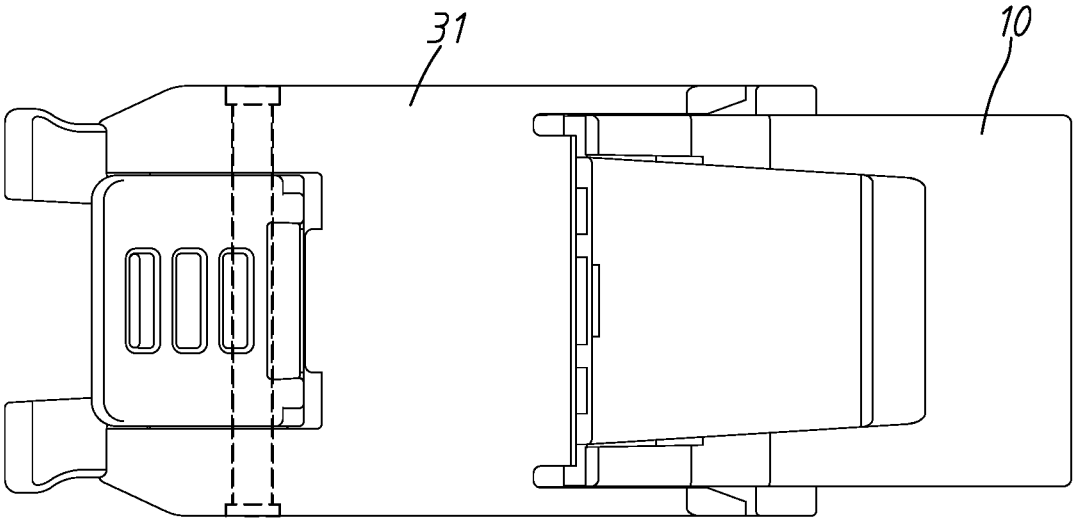
FIG. 4 is a top view of the receptacle connector of FIG. 1.

As shown in FIGS. 2 and 3, the cable clamping module 30 includes a first clamping member 31, a second clamping member 32 and a cable clamper 33. The first clamping member 31 and the second clamping member 32 are pivoted to the housing 10 and can engage with each other. The cable clamper 33 is pivoted to the first clamping member 31. Two shafts 13 and 14 are disposed on opposite lateral surfaces of the housing 10. The first clamping member 31 is joined to the shaft 13 through the hole 301, and the second clamping member 32 is joined to the shaft 14 through the hole 302, whereby the first clamping member 31 and the second clamping member 32 rotate to house the rear case 12.

The first clamping member 31 includes a first main body 311, a recess portion 312, a pair of extending portions 313 and a pair of first engaging portions 314. The recess portion 312 is disposed on a surface of the first main body 311 away from the housing 10. The cable clamper 33 is disposed in the recess portion 312. A shaft F extends through the lateral wall 3121 and the cable clamper 33, whereby the cable clamper 33 is pivoted in the recess portion 312. The extending portions 313 are disposed on opposite lateral walls of the recess portion 312 and extend toward the second clamping member 32. The first engaging portion 314 are disposed on a pair of extending portions 313. The extending portion 313 is an extending rod, and the first engaging portion 314 is an engaging hole. The bottom of the recess portion 312 has a semi-circular notch for a cable extending therethrough.

The second clamping member 32 includes a second main body 321, a second engaging portion 322 and a cable holding portion 323. The second engaging portion 322 is disposed on a surface corresponding to the recess portion 312 of the first clamping member 31. The second engaging portion 322 of the embodiment is an engaging protrusion. The cable holding portion 323 extends from the surface along the extending direction of the cable. The surface has a semi-circular notch formed on the edge of the cable holding portion 323. When the first clamping member 31 abuts the second clamping member 32, the semi-circular notch of the recess portion 312 of the first clamping member 31 and the semi-circular notch of second clamping member 32 are assembled to form a through hole for the cable extending therethrough.

The cable clamper 33 includes a clamper main body 331, a clamping portion 332, a pair of first positioning portions 333 and a pair of pressing portions 334. The clamping portion 332 is disposed on a surface of the clamper main body 331 facing the cable. The first positioning portions 333 are disposed on opposite sides of the clamper maim body 331 and adjacent to the clamping portion 332. The pressing portion 334 are disposed on the first positioning portions 333. As shown in FIG. 3, the clamping portion 332 includes a plurality of protrusions 3321 arranged in an array, whereby the cable is firmly clamped by the clamping portion 332. The protrusions have conical shape, but they are limited thereto, as long as the shape of protrusions can increase the pressure and the friction force exerting on the cable, the protrusion can also be pyramid.

Figure 6:
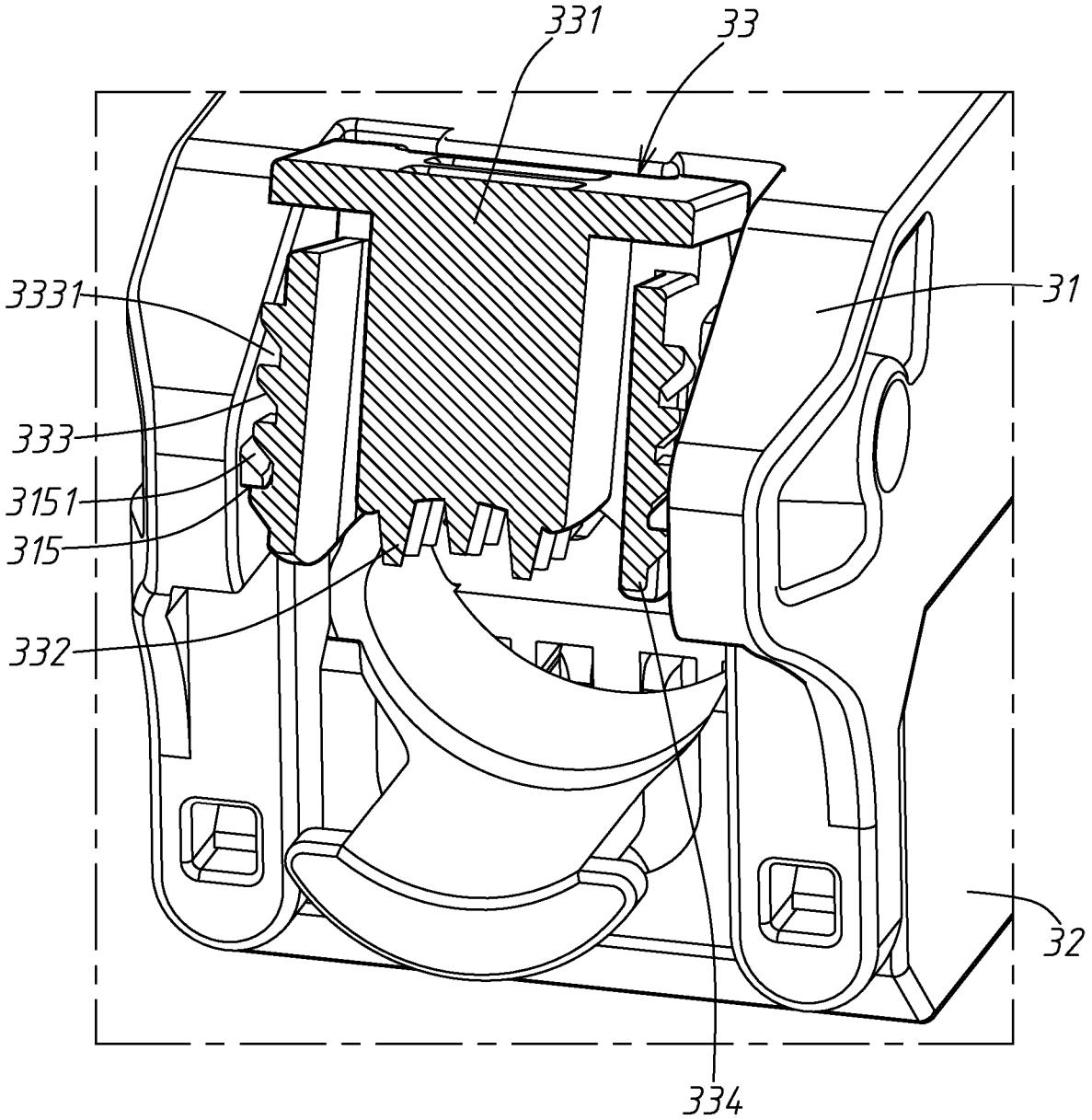
FIG. 6 depicts the cable clamper of the receptacle of FIG. 1 positioned on the first clamping member.

The first positioning portion 333 is a spring sheet and has a plurality of engaging grooves 3331. The pressing portions 334 are disposed on the top of the first positioning portion 333. The pressing portion 334 is pressed to move the first positioning portion 333 toward or away from the clamper main body 331. When the clamper main body 331 is disposed in the recess portion 312 of the first clamping member 31, the pressing portion 334 is pressed to move toward or away from walls of the recess portion 312. The first clamping member 31 further includes a second positioning portion 315 disposed on the wall of the recess portion 312 and corresponding to the first positioning portion 333. The first positioning portion 333 of the present embodiment includes a plurality of engaging grooves 3331 arranged in a row along the radial direction of the cable. The second positioning portion 315 includes an engaging protrusion includes an engaging protrusion 3151. The engaging protrusion 3151 selectively engages one of the engaging grooves 3331, whereby the distance between the cable clamper 33 and the second clamping member 32 varies depending on the diameter of the cable. As shown in FIG. 6, the cable extends through the first engaging member 31 and the second engaging member 32 engaging the first engaging member 31. The clamping portion 331 of the cable clamper 31 presses the cable, and one of the engaging grooves 3331 of the first positioning portion 333 is positioned to the engaging protrusion 3151 of the second positioning portion 315.

As shown in FIGS. 2 and 5, the receptacle connector further includes a wire distributing cover 40 disposed among the housing 10, the first clamping member 31 and the second clamping member 32. The wire distributing cover 40 has a cable insertion opening 41 for the cable extending therethrough. The wire distributing cover 40 further includes a plurality of securing slots 42 corresponding to the prick type terminal slots. The wires of the cable are secured in the securing slots 42 respectively. When the wire distributing cover 40 covers the prick type terminal slots of the rear case 12 along with the wires secured in the securing slots, the prick type terminals pierce the wires to achieve electrical connection.

Figure 7:
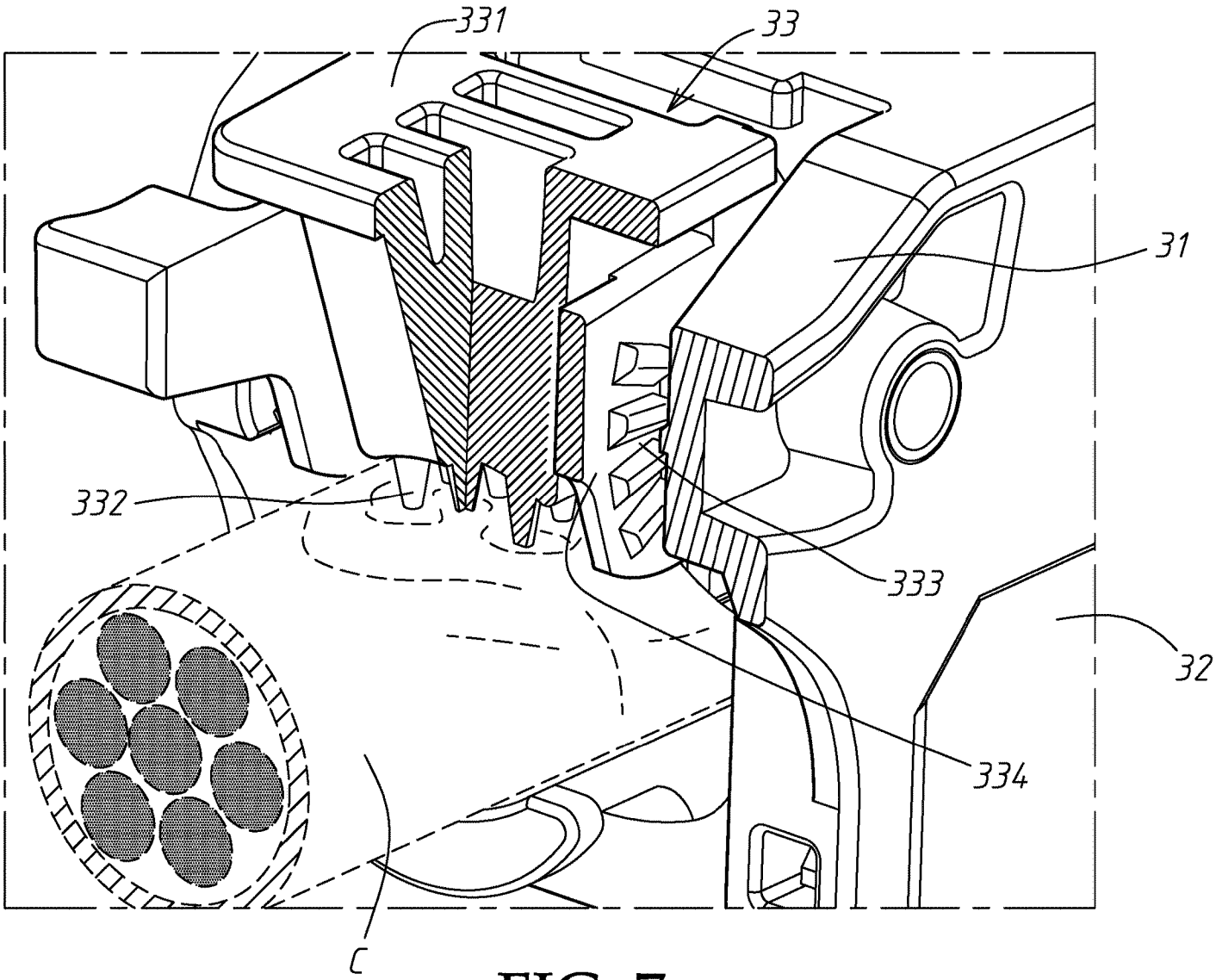
FIG. 7 is a schematic view of the cable clamper of the receptacle of FIG. 1 pressing the cable.

As shown in FIG. 7, when the wire distributing cover 40 covers the prick type terminal slots of the rear case 12 along with the wires secured in the securing slots, the first clamping member 31 and the second clamping member 32 house the rear case 12 to push the wire distributing cover 40, whereby the prick type terminals pierce the wires to achieve electrical connection. The clamping portion 332 of the cable clamper 33 presses the cable C, whereby the cable clamping module 30 firmly clamps the cable.

Figure 8:
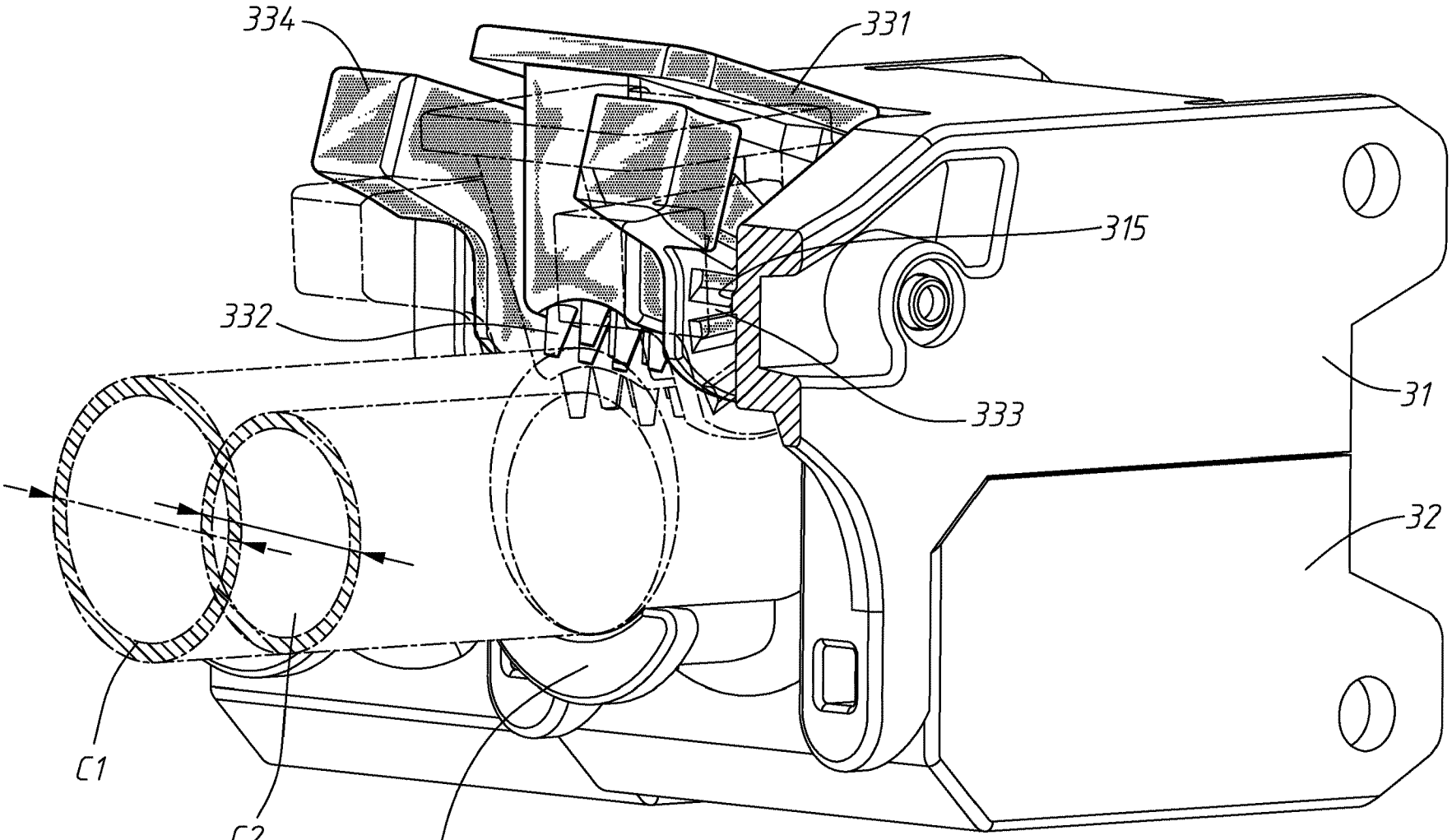
FIG. 8 is a schematic view of the cable clamper of the receptacle of FIG. 1 pressing the cables of different diameters.

As shown in FIG. 8, the engaging protrusion 3151 of the second positioning portion 315 selectively engages one of the engaging grooves 3331, whereby the cable clamper 33 is positioned to the first engaging member 31. The engaging protrusion 3151 engages different engaging grooves 3331, whereby the distance between the cable clamper 33 and the second clamper 32 varies so as to clamp the cables of different diameters.

Figure 9:
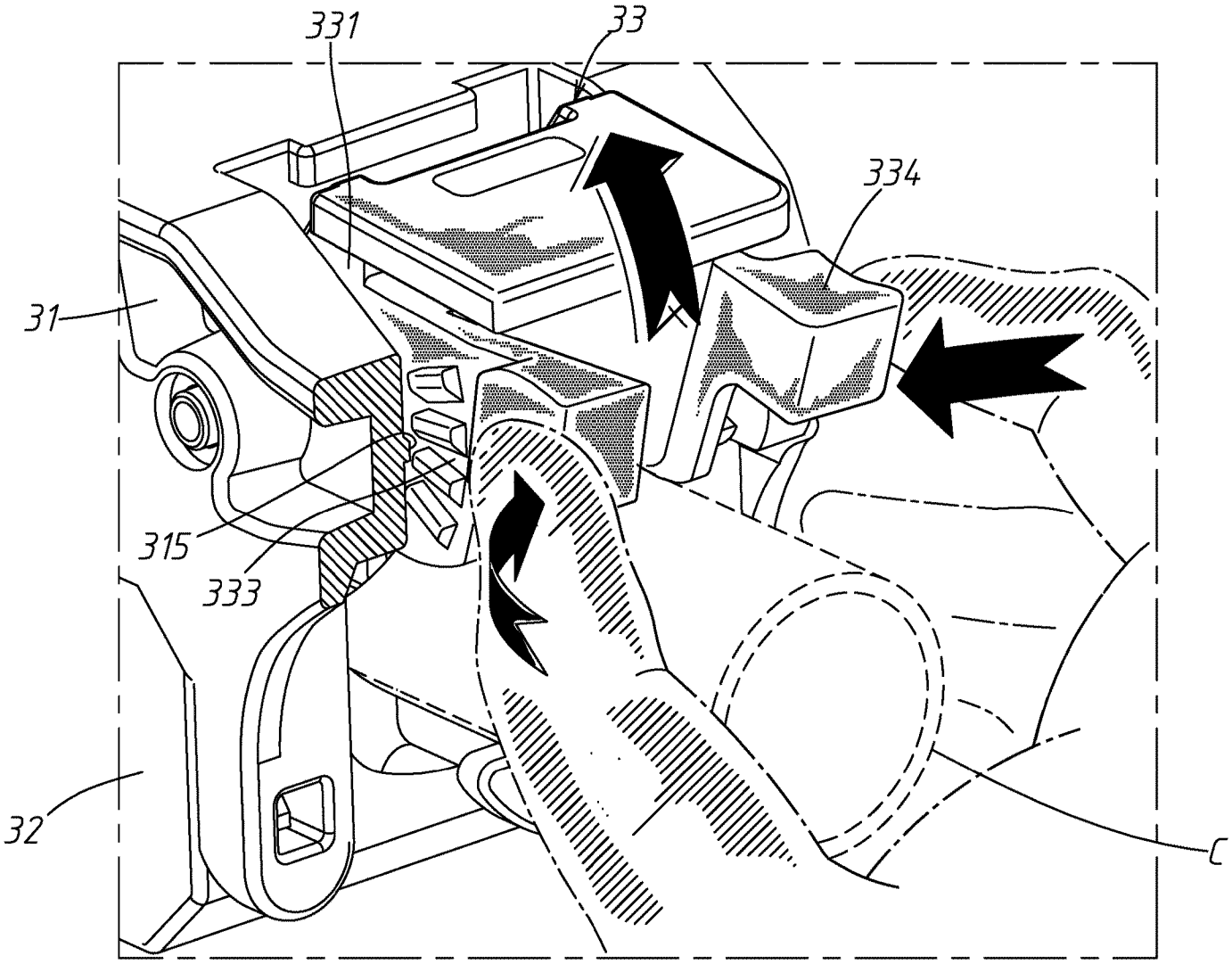
FIG. 9 is a schematic view of the cable clamper of the receptacle of FIG. 1 disengaging the first clamping member.

As shown in FIG. 9, the pressing portion 334 of the cable clamper 33 is pressed to separate the engaging grooves 3331 from the engaging protrusion 3151, whereby the cable clamper 33 can be rotated to leave the cable C.

The receptacle connector with cable-clamped structure of the invention includes the cable clamper 33 disposed in the first clamping member 31, and the cable clamper 33 can be rotated to adjust the pressing position and positioned to the first engaging member 31. Even if the network cable is offset, the cable clamper 33 still clamps the cable.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A receptacle connector with a cable-clamped structure, comprising:

a housing comprising a front case and a rear case, wherein the front case has a receiving opening through which a plug connector is inserted and an accommodating space;

an electrical module disposed in the housing and comprising a circuit board disposed between the front case and the rear case, a plurality of contacting terminals disposed on the printed circuit board, wherein the contacting terminals are disposed near the receiving opening for contacting terminals of the plug connector, and the printed circuit board is connected to a wire of a cable; and a cable clamping module comprising a first clamping member, a second clamping member and a cable clamper, wherein the first clamping member engages the second clamping member, and the cable clamper is connected to the first clamping member via a shaft and is pivot on the shaft;

wherein the cable clamper comprises a clamping portion and a first positioning portion, the first clamping member comprises a second positioning portion, a cable extends through the first clamping member and the second clamping member engaging the first clamping member, the clamping portion presses the cable with the first positioning portion positioned in the second positioning portion of the first clamping portion.

2. The receptacle connector as claimed in claim 1, wherein the first positioning portion comprises a plurality of engaging grooves, the second positioning portion comprises an engaging protrusion selectively engaging one of the engaging grooves, whereby a distance between the cable clamper and the second clamping member varies.

3. The receptacle connector as claimed in claim 2, wherein the cable clamper further comprises a clamper body, and the first positioning portion is deformable and disposed in the clamper body so as to alter a distance between the engaging protrusion and the engaging grooves.

4. The receptacle connector as claimed in claim 3, wherein cable clamper further comprises a pressing portion disposed on the first positioning portion, and the pressing portion is pressed to move the first positioning portion toward or away from the second positioning portion, whereby the engaging protrusion engages or disengages the engaging grooves.

5. The receptacle connector as claimed in claim 3, wherein the first clamping portion has a recess portion in which the cable clamper is pivoted, and the second positioning portion is disposed on a lateral wall of the recess portion.

6. The receptacle connector as claimed in claim 1, wherein the pressing portion comprises a plurality of protrusions pressing the cable.

7. The receptacle connector as claimed in claim 1, wherein the first clamping member comprises a first main body, at least one extending portion extending from the first main body toward the second clamping member, and a first engaging portion disposed on the extending portion, and the second clamping member comprises a second engaging portion engaging the first engaging portion, whereby the first clamping member is joined to the second clamping member.

8. The receptacle connector as claimed in claim 1, wherein the second clamping member comprises a second main body and a cable holding portion extending from the second main body along a direction parallel to the cable, the cable holding portion is opposite to the cable clamper, and the cable is clamped between the cable holding portion and the cable clamper.

9. The receptacle connector as claimed in claim 1, further comprising a wire distributing cover disposed among the housing, the first clamping member and the second clamping member.

10. The receptacle connector as claimed in claim 9, the wire distributing cover has a cable insertion opening through which the cable extends.

* * * * *